US008408338B2

(12) United States Patent
Richert

(10) Patent No.: US 8,408,338 B2
(45) Date of Patent: Apr. 2, 2013

(54) IMPREGNATED ROTARY DRAG BIT WITH ENHANCED DRILL OUT CAPABILITY

(75) Inventor: Volker Richert, Celle/Gross-Hehlen (DE)

(73) Assignee: Baker Hughes Incorporated, Houston, TX (US)

( * ) Notice: Subject to any disclaimer, the term of this patent is extended or adjusted under 35 U.S.C. 154(b) by 239 days.

(21) Appl. No.: 12/559,980

(22) Filed: Sep. 15, 2009

(65) Prior Publication Data

US 2011/0061943 A1 Mar. 17, 2011

(51) Int. Cl.
*E21B 10/36* (2006.01)
*E21B 10/567* (2006.01)
*E21B 10/573* (2006.01)

(52) U.S. Cl. ..... 175/426; 175/425; 175/428; 175/431

(58) Field of Classification Search ..... 175/425–435; 76/10.2, 108.48

See application file for complete search history.

(56) References Cited

U.S. PATENT DOCUMENTS

| | | | | |
|---|---|---|---|---|
| 3,825,080 | A * | 7/1974 | Short | 175/65 |
| 4,202,419 | A * | 5/1980 | Youngblood | 175/374 |
| 4,471,845 | A * | 9/1984 | Jurgens | 175/431 |
| 4,913,247 | A * | 4/1990 | Jones | 175/434 |
| 4,943,488 | A | 7/1990 | Sung et al. | |
| 5,049,164 | A | 9/1991 | Horton et al. | |
| 6,510,906 | B1 | 1/2003 | Richert et al. | |
| 6,601,661 | B2 * | 8/2003 | Baker et al. | 175/341 |
| 6,766,870 | B2 * | 7/2004 | Overstreet | 175/374 |
| 6,843,333 | B2 | 1/2005 | Richert et al. | |
| 7,240,746 | B2 * | 7/2007 | Overstreet et al. | 175/374 |
| 2007/0284153 | A1 * | 12/2007 | Richert et al. | 175/432 |
| 2008/0029312 | A1 * | 2/2008 | Hall et al. | 175/429 |
| 2010/0219000 | A1 * | 9/2010 | Doster | 175/428 |

* cited by examiner

*Primary Examiner* — Cathleen Hutchins
(74) *Attorney, Agent, or Firm* — TraskBritt

(57) ABSTRACT

A drill bit employing a plurality of abrasive, particulate-impregnated cutting structures extending upwardly from a bit face and defining a plurality of fluid passages therebetween. The plurality of cutting structures may be configured as spaced posts, or as blades with circumferentially extending grooves at radially spaced intervals. Superabrasive cutting elements in the form of thermally stable diamond are placed between the posts or in the grooves, depending on the cutting structure configuration, and at a reduced exposure. Additional cutting elements may be placed in a cone of the bit surrounding a centerline thereof. The blades may extend generally radially. Additionally, discrete protrusions may extend outwardly from at least some of the plurality of cutting structures. The discrete protrusions may be formed of thermally stable diamond.

20 Claims, 7 Drawing Sheets

IMPREGNATED ROTARY DRAG BIT WITH ENHANCED DRILL OUT CAPABILITY

TECHNICAL FIELD

Embodiments of the present invention relate generally to fixed-cutter bits, also known as "drag" bits for drilling subterranean formations and, more specifically, to drag bits for drilling hard and/or abrasive rock formations, and especially for drilling such formations interbedded with soft and non-abrasive layers. In addition, embodiments of the present invention have utility in drilling out casing components prior to drilling a subterranean formation.

State of the Art: So-called "impregnated" drag bits are used conventionally for drilling hard and/or abrasive rock formations, such as sandstones. Such conventional impregnated drill bits typically employ a cutting face composed of superabrasive cutting particles, such as natural or synthetic diamond grit, dispersed within a matrix of wear-resistant material. As such a bit drills, the matrix and embedded diamond particles wear, worn cutting particles are lost and new cutting particles are exposed. These diamond particles may be cast integral with the body of the bit, as in low-pressure infiltration, or may be preformed separately, as in hot isostatic pressure (HIP) process, and attached to the bit by brazing or furnaced to the bit body during manufacturing thereof by an infiltration process.

Conventional impregnated bits generally exhibit a poor hydraulics design by employing a crow's foot to distribute drilling fluid across the bit face and providing only minimal flow area. Further, conventional impregnated bits do not drill effectively when the bit encounters softer and less abrasive layers of rock, such as shales. When drilling through shale, or other soft formations, with a conventional impregnated drag bit, the cutting structure tends to quickly clog or "ball up" with formation material, making the drill bit ineffective. The softer formations can also plug up fluid courses formed in the drill bit, causing heat buildup and premature wear of the bit. Therefore, when shale-type formations are encountered, a more aggressive bit is desired to achieve a higher rate of penetration (ROP). It follows, therefore, that selection of a bit for use in a particular drilling operation becomes more complicated when it is expected that formations of more than one type will be encountered during the drilling operation.

Moreover, during the drilling of a well bore, the well may be drilled in multiple sections wherein at least one section is drilled followed by the cementing of a tubular metal casing within the borehole. In some instances, several sections of the well bore may include casing of successively smaller sizes, or a liner may be set in addition to the casing. In cementing the casing (such term including a liner) within the borehole, cement is conventionally disposed within an annulus defined between the casing and the borehole wall by pumping the cement downwardly through the casing to the bottom thereof and then displacing the cement into the well bore through a check valve in the form of a so-called "float shoe" such that the cement flows back upwardly through the annulus. Such a process conventionally results in a mass or section of hardened cement proximate the float shoe and formed at the lower extremity of the casing or liner. Thus, in order to drill the well bore to further depths, it becomes necessary to first drill through the float shoe and mass of cement.

Conventionally, the drill bit used to drill out the cement and float shoe may not exhibit the desired design for drilling the subterranean formation that lies therebeyond. Thus, those drilling the well bore are often faced with the decision of changing out drill bits after the cement and float shoe have been penetrated or, alternatively, continuing with a drill bit that may not be optimized for drilling the subterranean formation below the casing.

It was recognized that it would be beneficial to design a drill bit, which would perform more aggressively in softer, less abrasive formations while also providing adequate ROP in harder, more abrasive formations without requiring increased weight on bit (WOB) during the drilling process.

Additionally, it was recognized that it would be advantageous to provide a drill bit with "drill out" features, which enable the drill bit to drill through a float shoe and cement, and continue drilling the subsequently encountered subterranean formation in an efficient manner.

The inventor herein, with others, developed drill bits to address these needs, such drill bits being disclosed and claimed in U.S. Pat. Nos. 6,510,906 and 6,843,333, assigned to the assignee of the present invention and the disclosure of each of which patents is hereby incorporated by reference herein.

It has been noted by the inventor herein that, despite the effectiveness and commercial success of the drill bits of the foregoing patents, that additional improvements might be made to impregnated bit design to reduce, or even prevent, debris such as rock fragments, as well as metal and plastic debris from drill out, from sticking within and between cutting structures on the bit face.

BRIEF SUMMARY

The present invention, in various embodiments, comprises a rotary drag bit employing impregnated cutting structures, in combination with recessed cutting elements disposed in discontinuities between the impregnated cutting structures.

In one embodiment, the impregnated cutting structures comprise discrete, post-like, cutting structures projecting upwardly from generally radially extending blades on the bit face, the cutting structures mutually separated by gaps, and the blades defining fluid passages therebetween extending to junk slots on the bit gage.

In another embodiment, the impregnated cutting structures comprise generally radially extending blades with the blades having discontinuities therein in the form of grooves extending generally circumferentially from one side of a blade to a circumferentially opposite side. The blades define fluid passages therebetween extending to junk slots on the bit gage.

In each of the above embodiments, the drill bit further comprises cutting elements recessed from the outer ends of the impregnated cutting structures. In the embodiment with post-like cutting structures, the cutting elements are disposed in the gaps between the posts, while in the embodiment with discontinuous blades, the cutting elements are disposed in the grooves. The cutting elements may comprise superabrasive structures in the form of, by way of non-limiting example, thermally stable polycrystalline diamond compacts, known in the art as "TSPs," for "thermally stable products."

In any of the embodiments, generally discrete cutting protrusions may, optionally extend from the outer surfaces of the impregnated cutting structures. The discrete cutting protrusions may be formed of a material comprising, for example, TSPs. In one particular embodiment, the TSPs may be positioned to exhibit a generally triangular cross-sectional geometry taken in a direction that is normal to an intended direction of bit rotation. Such discrete cutting protrusions enable the bit to drill through features such as a cement shoe at the bottom of a well bore casing.

In some embodiments, the cone portion, or central area of the bit face, may be of a relatively shallow configuration and may be provided with cutting elements such as, for example, superabrasive cutters in the form of polycrystalline diamond compacts (PDCs), TSPs, natural diamonds, superabrasive-impregnated segments, or a combination of two or more thereof.

DETAILED DESCRIPTION OF THE INVENTION

Figure 1:
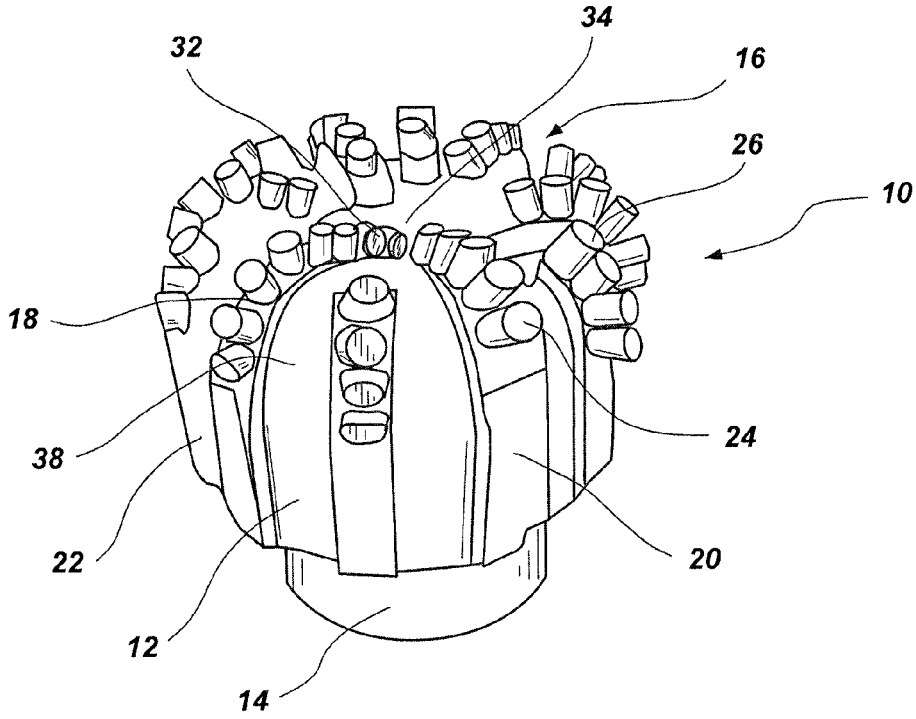
FIG. 1 comprises an inverted perspective view of an impregnated bit that may be provided with features according to embodiments of the present invention.

For clarity in description, various features and elements common among the embodiments of the invention may be referenced with the same or similar reference numerals.

Referring now to FIGS. 1, 2, 2A and 2B of the drawings, an impregnated bit 10 is depicted in perspective, bit 10 being inverted from its normal face-down operating orientation for clarity. Bit 10 is, by way of example only, of 8 ½" diameter and includes a matrix-type bit body 12 having a shank 14 for connection to a drill string (not shown) extending therefrom opposite bit face 16. A plurality of (in this instance, twelve (12)) blades 18 separated by a like plurality of fluid courses 38 extends generally radially outwardly in linear fashion from a centerline of the bit body 12 to a gage including gage pads 20 defining junk slots 22 therebetween. Bit 10, as depicted, is as disclosed in the aforementioned U.S. Pat. No. 6,510,906. Such a bit 10 may be manufactured with features and elements according to embodiments of the present invention, so a general description thereof follows to provide an enhanced understanding thereof.

Unlike conventional impregnated bit cutting structures, the discrete, impregnated cutting structures 24 comprise posts extending upwardly (as shown in FIG. 1) on blades 18 from the bit face 16. The discrete cutting structures 24 are formed as an integral part of the matrix-type blades 18 projecting from a matrix-type bit body 12 by hand-packing diamond grit-impregnated matrix material in mold cavities on the interior of the bit mold defining the locations of the cutting structures 24 and blades 18 and, thus, each blade 18 and associated cutting structure 24 defines a unitary structure. It is noted that the cutting structures 24 may be placed directly on the bit face 16, dispensing with the blades. It is also noted that, while discussed in terms of being integrally formed with the bit 10, the cutting structures 24 may be formed as discrete individual segments, such as by hot isostatic pressing, and subsequently brazed or furnaced onto the bit 10.

Discrete cutting structures 24 are mutually separate from each other to promote drilling fluid flow therearound for enhanced cooling and clearing of formation material removed by the diamond grit. Discrete cutting structures 24, as shown in FIG. 1, are generally of a round or circular transverse cross-section at their substantially flat, outermost ends 26.

PDC cutting structures 32 may be employed within a cone of drill bit 10, proximate centerline 34.

While the cutting structures 24 are illustrated as exhibiting posts of circular outer ends and oval shaped bases, other geometries are also contemplated. It is also noted that the spacing between individual cutting structures 24, as well as the magnitude of the taper from the outermost ends 26 to the blades 18, may be varied to change the overall aggressiveness of the bit 10 or to change the rate at which the bit is transformed from a light-set bit to a heavy-set bit during operation. It is further contemplated that one or more of such cutting structures 24 may be formed to have substantially constant cross-sections if so desired depending on the anticipated application of the bit 10.

Discrete cutting structures 24 may comprise a synthetic diamond grit, such as, for example, DSN-47 Synthetic diamond grit, commercially available from DeBeers of Shannon, Ireland, which has demonstrated toughness superior to natural diamond grit. The tungsten carbide matrix material with which the diamond grit is mixed to form discrete cutting structures 24 and supporting blades 18 may desirably include a fine grain carbide, such as, for example, DM2001 powder commercially available from Kennametal Inc., of Latrobe, PA. Such a carbide powder, when infiltrated, provides increased exposure of the diamond grit particles in comparison to conventional matrix materials due to its relatively soft, abradable nature. A base of each blade 18 may desirably be formed of, for example, a more durable 121 matrix material, obtained from Firth MPD of Houston, TX. Use of the more durable material in this region helps to prevent ring-out even if all of the discrete cutting structures 24 are abraded away and the majority of each blade 18 is worn.

It is noted, however, that alternative particulate abrasive materials may be suitably substituted for those discussed above. For example, the discrete cutting structures 24 may include natural diamond grit, or a combination of synthetic and natural diamond grit. Alternatively, the cutting structures may include synthetic diamond pins. Additionally, the particulate abrasive material may be coated with a single layer or multiple layers of a refractory material, as known in the art and disclosed in U.S. Pat. Nos. 4,943,488 and 5,049,164, the disclosures of each of which are hereby incorporated herein by reference in their entirety. Such refractory materials may include, for example, a refractory metal, a refractory metal carbide or a refractory metal oxide. In one embodiment, the coating may exhibit a thickness of approximately 1 to 10 microns. In another embodiment, the coating may exhibit a thickness of approximately 2 to 6 microns. In yet another embodiment, the coating may exhibit a thickness of less than 1 micron.

Figure 2:
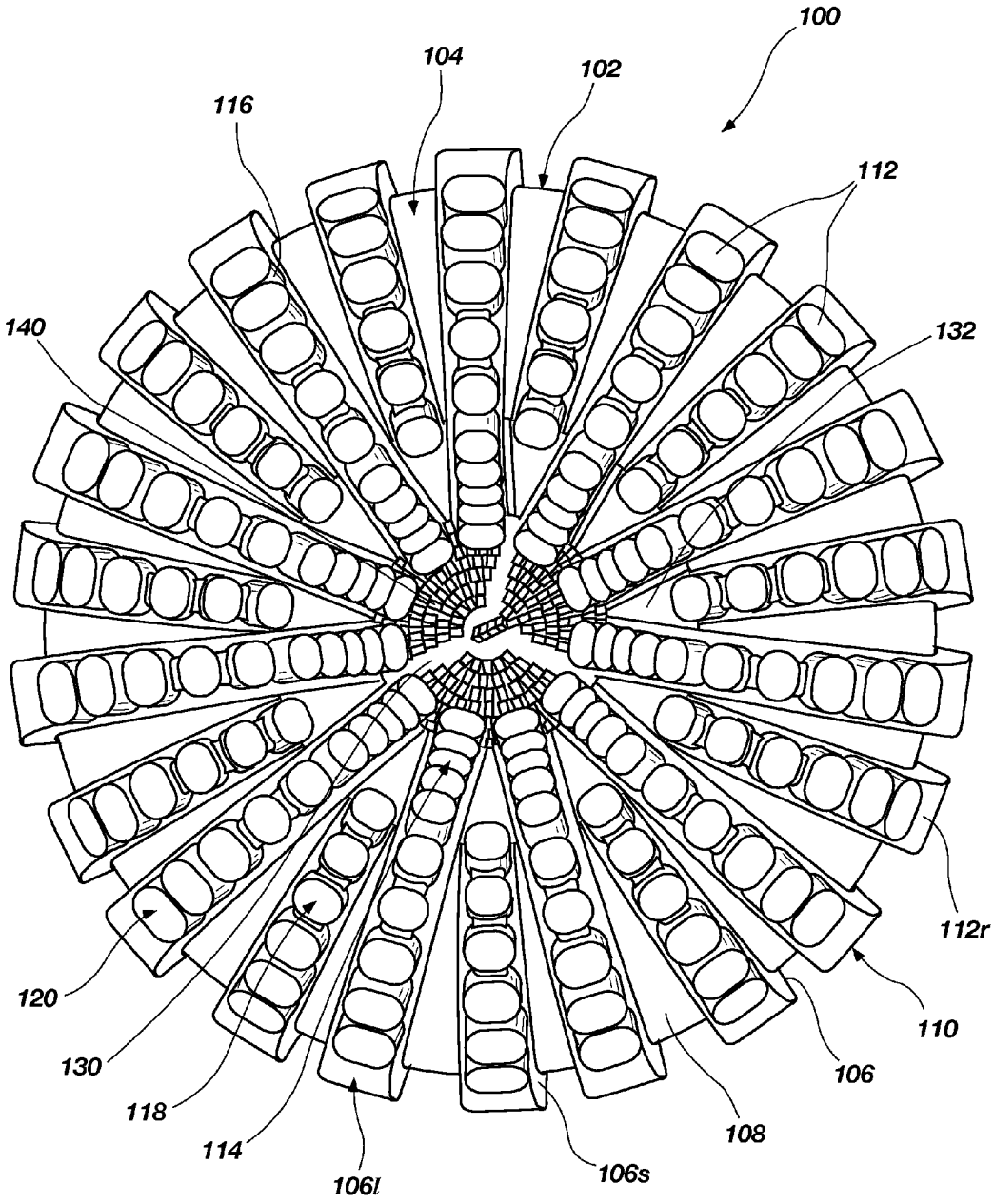
FIG. 2 is a frontal elevation of a bit face of the bit of FIG. 1.

Referring now to FIG. 2, a face of a bit 100 in accordance with one embodiment of the present invention is depicted. Bit 100 comprises a body having a shank secured thereto as described above with respect to FIG. 1, and in that regard no further description is warranted. Bit body 102 comprises a face 104 having a plurality of generally radially extending blades 106 thereon, the blades 106 defining fluid passages 108 therebetween extending to a gage 110 of the bit body 102. Each blade 106 bears a plurality of impregnated, outwardly protruding, post-like cutting structures 112 thereon. The post-like cutting structures are 112 are positioned in a partially overlapping, abutting relationship within a cone 114 of the bit 100 to form a continuous, wall-like structure, and are radially separated outwardly of the cone 114 by gaps 116, which may also be characterized as discontinuities, commencing at the radially outer portion of the cone 114 and extending over nose 118 to a shoulder 120, wherein the blade 106 may extend outwardly to a higher elevation than radially inward portions thereof. Within the region of the shoulder 120, the blades 106 may, rather than having post-like cutting structures 112 protruding therefrom, comprise a radially continuous cutting structure 112*r* extending to the gage 110 of the bit body and having diamond grit disposed therein.

It will be appreciated from FIG. 2 that post-like cutting structures 112 of adjacent rows are staggered radially, so that in a circumferential direction, cutting structures of one blade 106 are aligned with gaps 116 between cutting structures 112 of an adjacent blade 106.

As depicted in FIG. 2, radially longer blades 106*l*, which extend farther into cone 114 are circumferentially separated by radially foreshortened blades 106*s*. Also as depicted in FIG. 2, cutting structures 112 which are separated by gaps 116 and which are relatively more radially inward on blades 106, such as those radially inward on foreshortened blades 106*s*, may be of substantially circular transverse cross-section, while those more radially outward are of more circumferentially elongated, oval cross-section, to provide more cutting area and diamond grit volume. The blades 106 and impregnated cutting structures 112 may be formed of the materials and using the processes described with respect to FIG. 1.

At the center of the cone 114 is an aperture in the form of a so-called "crowsfoot" 130, by which drilling fluid may be ejected onto the face of the bit. Radially outward of crowsfoot 130, apertures 132 radially inward of radially foreshortened blades 106*s* provide additional drilling fluid flow to fluid passages 108.

In the area of the crowsfoot 130 in cone 114, a plurality of TSP cutting elements 140 are positioned to enhance drilling efficiency and prevent center coring when drilling. As shown, the TSP cutting elements 140 may comprise relatively small, triangular elements set in a helical pattern. Alternatively, TSP cutting elements may be set in concentric, circular groups. Further, natural diamonds may be employed in lieu of TSPs, as may PDC cutting elements, or diamond-impregnated material, for selected applications.

Figure 2A:
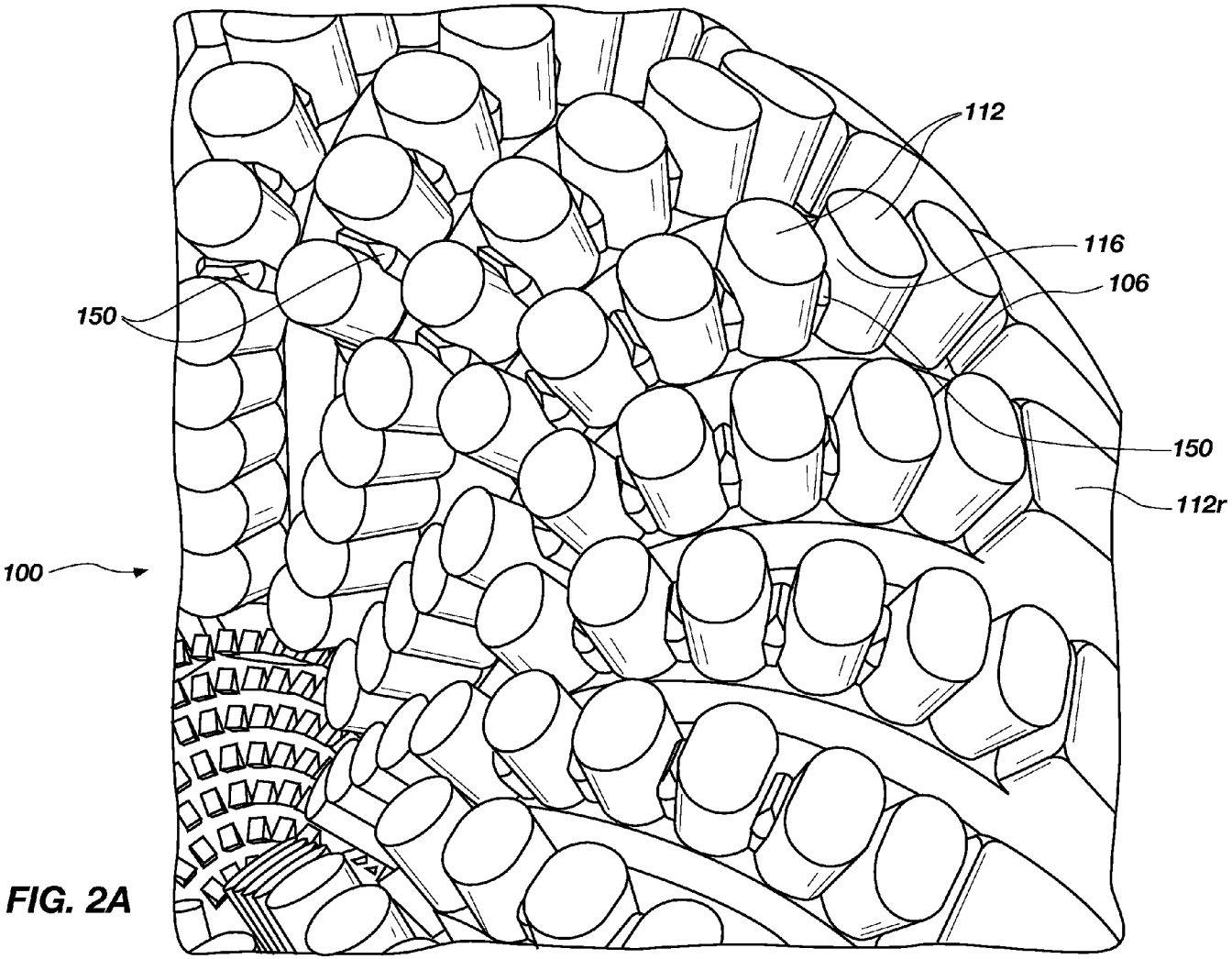
FIG. 2A is an enlarged perspective view of part of the bit face of FIG. 2.
Figure 2B:
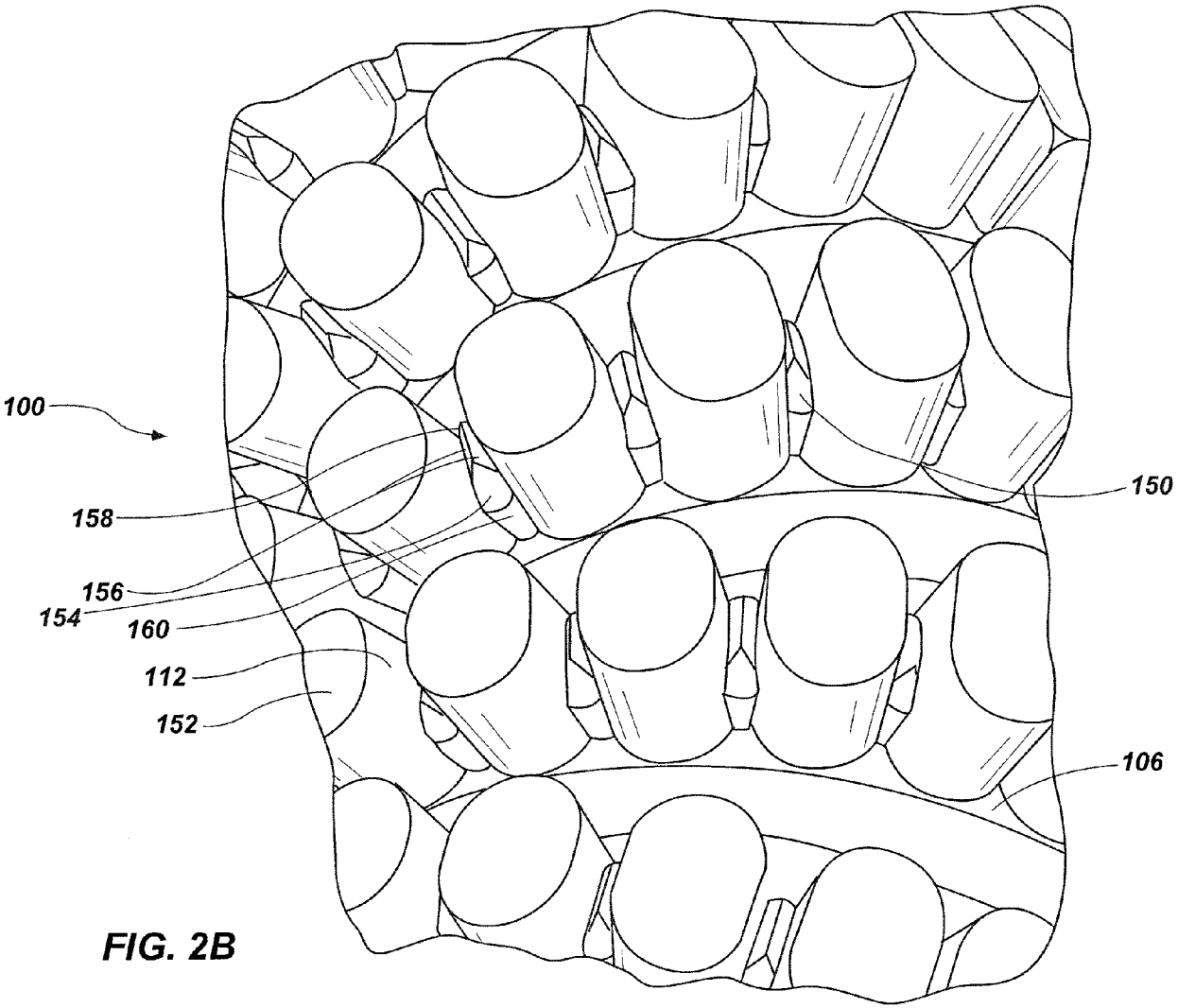
FIG. 2B is a further enlarged perspective view of part of the bit face of FIG. 2 showing wear of discrete, diamond grit-impregnated cutting structures and PDC cutters.

As depicted in FIG. 2, and as more clearly shown in FIGS. 2A and 2B, additional, larger TSP cutting elements 150 may be disposed within gaps 116. TSP cutting elements 150 are furnaced in place during manufacture of the bit 100 and, so, are anchored into underlying blades 106 as well as radially inwardly and radially outwardly into cutting structures 112 flanking the gap 116 in which each TSP cutting element 150 is disposed. As is readily apparent, TSP cutting elements 150 are recessed from the outer ends 152 of cutting structures 112. The recess distance may be selected in consideration of bit size and profile radius for a given drill bit. Further, TSP cutting elements 150 present a substantially triangular configuration, when viewed from a direction of intended bit rotation, and include rounded rotationally leading and trailing sides 154 extending between substantially flat faces 156 joining at apex 158. Sides 154 and faces 156 of each TSP cutting element 150 may extend to base 160, which may be of substantially constant transverse cross-section. Thus, as may be appreciated by one of ordinary skill in the art, TSP cutting elements 150 are secured in a robust manner to both flanking cutting structures 112 and blades 106 by portions of the bases 160, sides 154 and faces 156. Further, while only one TSP cutting element 150 is shown disposed in a gap 116, more than one TSP cutting element may be disposed in sufficiently circumferentially wide gaps 116, for example, on the nose 118 and shoulder 120, wherein post-like cutting structures 112 and underlying blades are of greater circumferential width. In addition, it is contemplated that natural diamonds may be used in lieu of TSPs, and TSPs of other than triangular configuration may be employed.

Figure 3A:
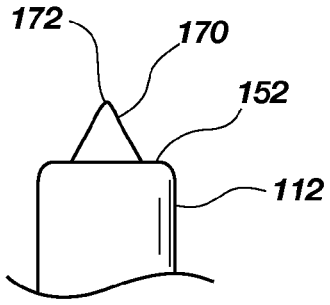
FIGS. 3A through 3C are enlarged side views of a cutting structure of the bit face of FIG. 2 bearing various configurations of an additional cutting protrusion at an outer end thereof.

Referring now to FIG. 3A, a cutting structure 112 is depicted. Cutting structure 112 includes a discrete cutting protrusion 170 at outer end 152 thereof, discrete cutting protrusion 170 comprising, for example, a TSP cutting element. As depicted, the TSP cutting element may present a substantially triangular configuration with a substantially sharp apex 172 when viewed from a direction of intended bit rotation. Cutting structure 112, as depicted in FIG. 3A, includes what may be termed "drill out" features that enable the bit 100 (FIGS. 2, 2A, and 2B) to drill through, for example, a float shoe and mass of cement at the bottom of a casing within a well bore.

A discrete cutting protrusion 170 extends from a central portion of the generally flat outer end 152 of some or all of the cutting structures 112. The discrete cutting protrusion 170 may have a base thereof embedded in the cutting structure 112 and be mechanically and metallurgically bonded thereto. The TSP material may be coated with, for example, a refractory material such as that described hereinabove.

Figure 3B:
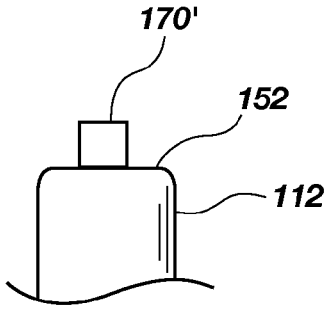
Figure 3C:
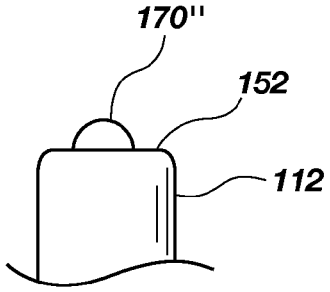

The discrete cutting protrusions 170 may exhibit other geometries as well. For example, FIG. 3B shows a discrete protrusion cutting protrusion 170' having a generally square or rectangular cross-sectional geometry when viewed from an intended direction of bit rotation and, thus, exhibits a generally flat outermost end. Another example is shown in FIG. 3C, wherein the discrete cutting protrusion 170" exhibits a generally rounded or semicircular cross-sectional area as taken normal to the intended direction of bit rotation. In additional, natural diamonds may be employed as discrete cutting protrusions.

Discrete cutting protrusions 170, 170' and 170" may be used to augment the cutting structures 112 for the penetration of, for example, a float shoe and associated mass of cement therebelow or similar structure prior to penetrating the underlying subterranean formation.

Figure 4:
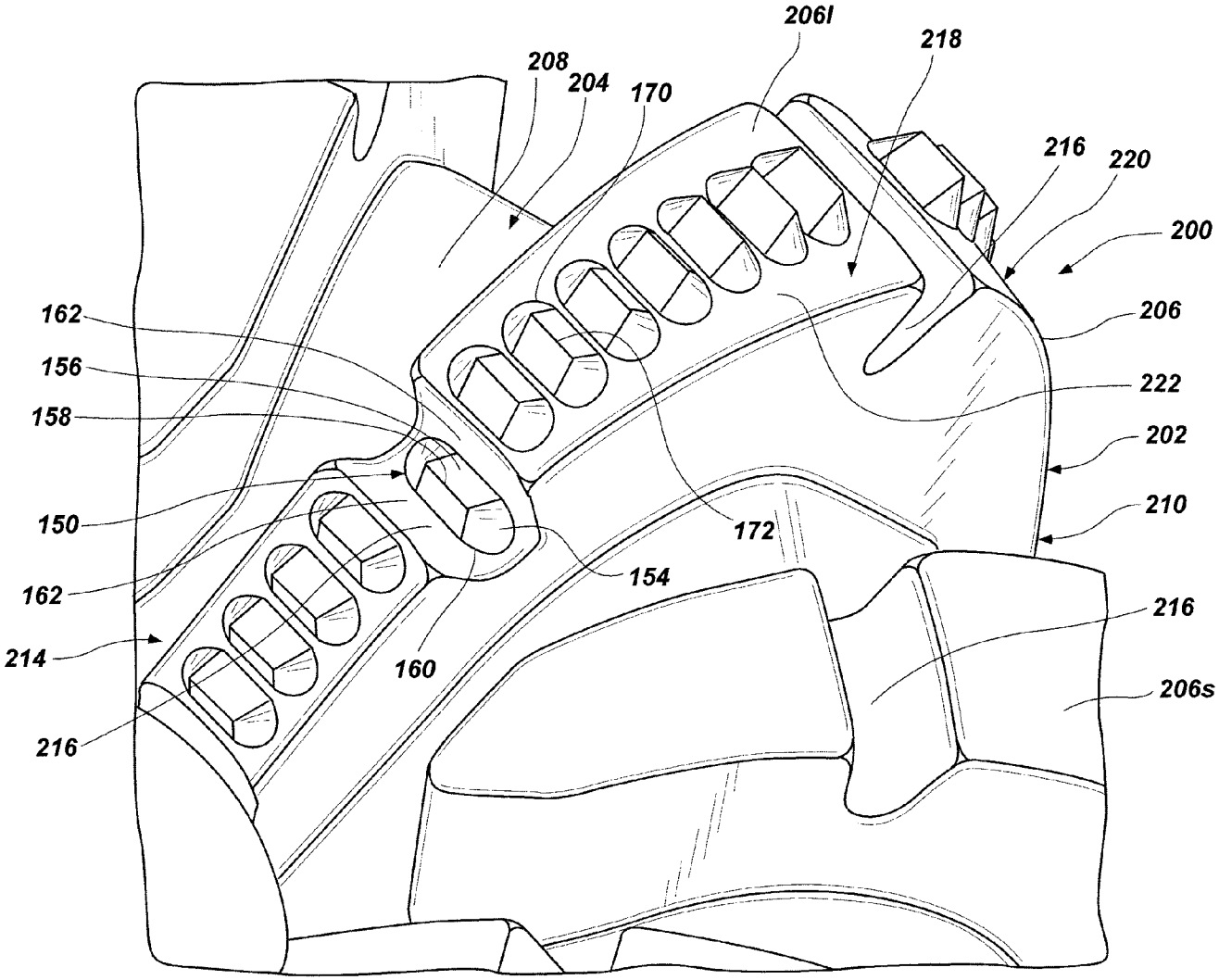
FIG. 4 is an enlarged perspective view of a portion of a bit face of another embodiment of the invention.
Figure 5:
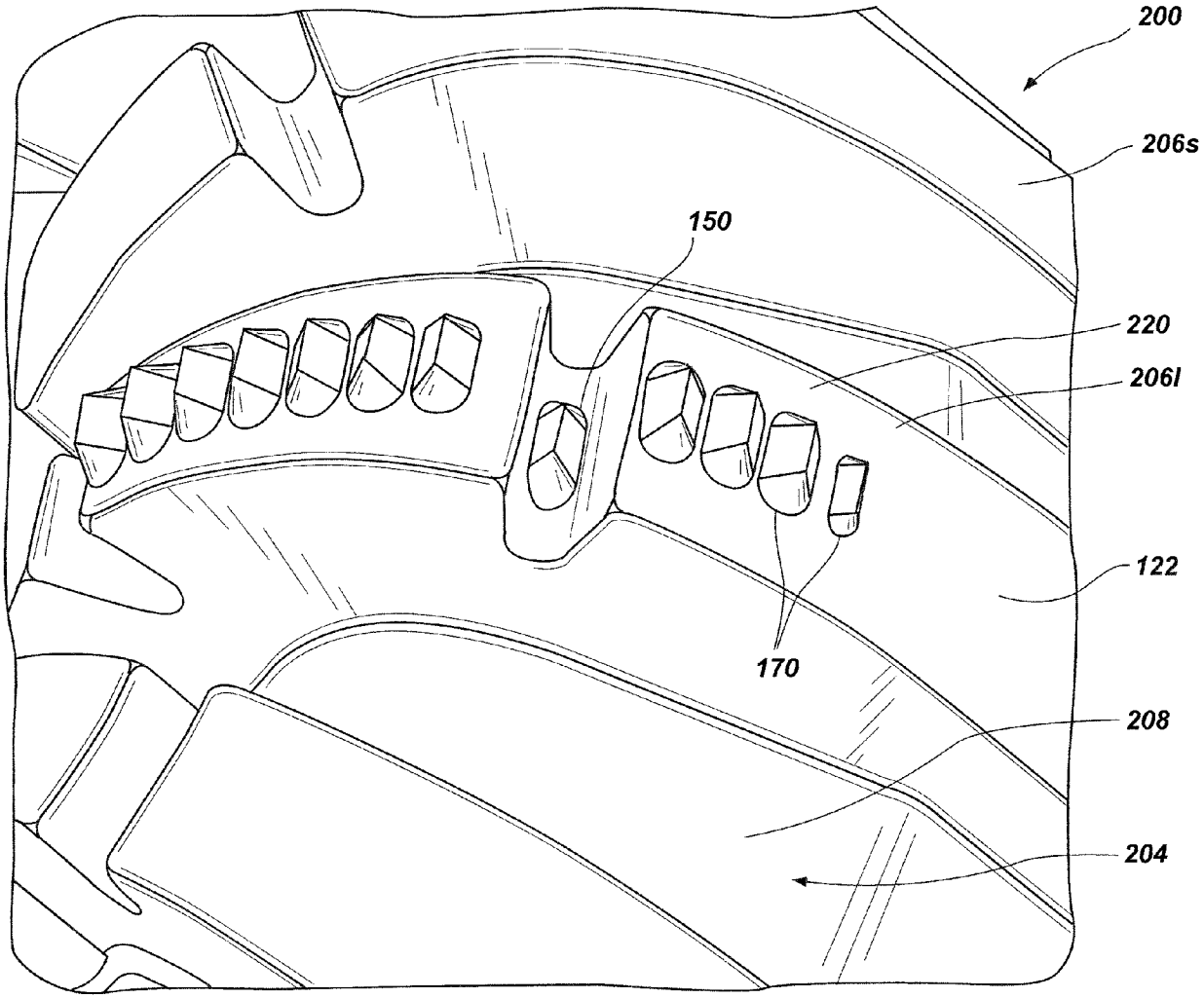
FIG. 5 is a further enlarged perspective view of a portion of a bit face of the embodiment of FIG. 4, from a different angle.

Referring now to FIGS. 4 and 5, portions of a face of a bit 200 according to another embodiment of the present invention are depicted. Bit 200 comprises a body having a shank secured thereto as described above with respect to FIG. 1, and in that regard no further description is warranted. Bit body 202 comprises a face 204 having a plurality of generally radially extending blades 206 thereon, the blades 206 defining fluid passages 208 therebetween extending to a gage 210 of the bit body 202. Unlike the previous embodiment, each blade 206 does not bear a plurality of impregnated, outwardly protruding, post-like cutting structures thereon but, rather, extends upwardly from the face 204 to a substantial height, which height may increase from within the cone 214 toward the nose 218 and over the shoulder 220 before reducing in height approaching the gage. Blades 206 are, as previously described with respect to post-like cutting structures, impregnated with diamond grit and, themselves comprise cutting structures. Blades 206 may be formed integrally with bit body 202 or, as with post-like cutting structures 112, be preformed, as by hot isostatic pressing, and then secured to bit body 202 by furnacing or brazing. Blades 206 are intersected at radially spaced intervals by circumferentially extending gaps 216 in the form of grooves in locations commencing, for example, at the radially outer portion of the cone 214 and extending over the nose 218 to the shoulder 220. As depicted in FIGS. 4 and 5, gaps 216 of adjacent blades 206 may be radially offset from one another to follow differential rotational cutting paths. As with the previous embodiment, blades 206 may comprise radially shorter blades 206*s* and radially longer blades 206*l*.

The hydraulic structure and the cutting structure disposed in the cone 114 of drill bit 200 may be the same as that depicted and described with respect to drill bit 100, and so need not be further addressed herein.

As in the previous embodiment, TSP cutting elements 150 may be disposed in some or all of gaps 216. Rather than being embedded in blade material on radially opposing sides of the gaps 216, however, the bases of TSP cutting elements 150 may be substantially entirely received within the material of blades 206 and a radial space 162 provided on either side thereof within a gap 216.

A plurality of discrete, radially separated cutting protrusions 170 for drill out purposes may be carried on outer surfaces 222 of some or all of blades 206, such discrete cutting protrusions 170 and alternative configurations 170' and 170" having been previously described with respect to FIGS. 3A through 3C. As particularly clearly shown in FIG. 5, discrete cutting protrusions 170 need not be of uniform size, or may be of uniform size but set to different depths within the blade material to provide different exposures above outer surfaces 222.

While the bits of the present invention have been described with reference to certain illustrated embodiments, those of ordinary skill in the art will recognize and appreciate that it is not so limited. Additions, deletions and modifications to the embodiments illustrated and described herein may be made without departing from the scope of the invention as defined by the claims herein, including legal equivalents. Similarly, features from one embodiment may be combined with those of another.

What is claimed is:

1. A rotary bit for drilling subterranean formations, comprising:

a bit body having a face extending from a bit centerline to a gage;

a plurality of cutting structures comprising a matrix material impregnated with particulate abrasive material protruding upwardly from the face and positioned in locations extending generally radially in locations between the bit centerline and the gage;

at least one discontinuity radially between at least two of the cutting structures of the plurality; and a cutting element disposed within the at least one discontinuity and having a lower maximum exposure than a maximum exposure of each of the at least two cutting structures.

2. The rotary bit of claim 1, wherein the cutting element comprises a superabrasive element.

3. The rotary bit of claim 2, wherein the cutting element is selected from the group consisting of natural diamond and thermally stable diamond product (TSP).

4. The rotary bit of claim 2, wherein the cutting element is partially embedded in material of the at least two cutting structures on opposing sides of the at least one discontinuity and in underlying material of the bit body.

5. The rotary bit of claim 2, wherein the exposed portion of the cutting element is of a triangular shape, a rounded shape or a rectangular shape, taken from a direction of intended bit rotation.

6. The rotary bit of claim 5, wherein the cutting element is of a triangular shape taken from a direction of intended bit rotation with opposing generally planar faces meeting at a generally linear apex extending generally in the direction of bit rotation and rounded rotationally leading and trailing sides extending between the opposing generally planar faces.

7. The rotary bit of claim 1, wherein the plurality of cutting structures comprises a plurality of post-like cutting structures disposed in generally radially extending rows, and wherein the at least one discontinuity comprises a gap between radially adjacent post-like cutting structures.

8. The rotary bit of claim 7, wherein at least some of the post-like cutting structures comprise substantially flat outer ends, and further comprising discrete cutting protrusions secured to the substantially flat outer ends of at least some of the post-like cutting structures and extending upwardly therefrom.

9. The rotary bit of claim 8, wherein the discrete cutting protrusions comprise superabrasive material.

10. The rotary bit of claim 9, wherein the superabrasive material is selected from the group consisting of natural diamond and polycrystalline diamond.

11. The rotary bit of claim 8, wherein exposed portions of the discrete cutting protrusions comprise a triangular shape, a rounded shape or a rectangular shape, taken from a direction of intended bit rotation.

12. The rotary bit of claim 1, wherein the particulate abrasive material comprises at least one of synthetic diamond grit and natural diamond grit.

13. The rotary bit of claim 1, wherein the face includes a cone portion surrounding the bit centerline and wherein at least one cutting element is disposed on the face of the bit body within the cone portion.

14. The rotary bit of claim 13, wherein the at least one cutting element comprises at least one of a polycrystalline diamond compact (PDC) cutting element, a thermally stable diamond product (TSP), a material comprising natural diamonds, and a diamond-impregnated material.

15. The rotary bit of claim 1, wherein the matrix material of the plurality of cutting structures comprises a metal material and the particulate abrasive material comprises a diamond grit material.

16. A rotary bit for drilling subterranean formations, comprising:

a bit body having a face extending from a centerline to a gage;

a plurality of cutting structures comprising a particulate abrasive material protruding upwardly from the face and positioned in locations extending generally radially in locations between the centerline and the gage;

at least one discontinuity radially between at least two of the cutting structures of the plurality; and a cutting element disposed within the at least one discontinuity and having an exposed portion recessed below outer surfaces of the at least two cutting structures;

wherein the plurality of cutting structures comprises a plurality of generally radially extending blades, and wherein the at least one discontinuity comprises a groove in at least one blade extending in a circumferential direction across the blade from one side to an opposing side.

17. The rotary bit of claim 16, wherein at least portions of outer surfaces of the blades comprise discrete cutting protrusions secured thereto and extending upwardly therefrom.

18. The rotary bit of claim 17, wherein the discrete cutting protrusions comprise superabrasive material.

19. The rotary bit of claim 18, wherein the superabrasive material is selected from the group consisting of natural diamond and polycrystalline diamond.

20. The rotary bit of claim 17, wherein exposed portions of the discrete cutting protrusions comprise a triangular shape, a rounded shape or a rectangular shape, taken from a direction of intended bit rotation.

* * * * *